United States Patent [19]

Feder

[11] 4,084,532

[45] Apr. 18, 1978

[54] LINE CLEATS FOR SECURING ROPES, BUT ESPECIALLY FOR LINES TO SAILS OF SAILBOATS

[76] Inventor: Emil Feder, Koelnische Strasse 101, 3599 Kassel, Germany

[21] Appl. No.: 709,721

[22] Filed: Jul. 29, 1976

[30] Foreign Application Priority Data

| | | |
|---|---|---|
| Aug. 1, 1975 | Germany | 2534474 |
| Nov. 17, 1975 | Germany | 2551486 |

[51] Int. Cl.[2] ..... B63B 21/08

[52] U.S. Cl. ..... 114/218

[58] Field of Search ..... 114/199, 218; 24/134 P, 24/134 CP

[56] References Cited

U.S. PATENT DOCUMENTS

| | | | |
|---|---|---|---|
| 2,262,162 | 11/1941 | Bock | 24/134 CP |
| 2,519,680 | 8/1950 | Macumber | 24/134 CP |
| 3,265,032 | 8/1966 | Hume | 114/218 |
| 3,730,129 | 5/1973 | Helms | 114/218 |
| 3,730,483 | 5/1973 | Newell | 114/218 |
| 3,795,218 | 3/1974 | Merry | 114/218 |

*Primary Examiner*—Trygve M. Blix
*Assistant Examiner*—Stuart M. Goldstein
*Attorney, Agent, or Firm*—Blanchard, Flynn, Thiel, Boutell & Tanis

[57] ABSTRACT

A line cleat for use in a sailboat environment having a base plate and a pair of cam elements pivotally mounted on the base plate about spaced axes normal to the base plate. The cam elements have eccentric confronting faces that coact to define a line-gripping nip therebetween. The cam elements are displaceable about the axes of the cam elements to permit a line to enter the nip and to pass therethrough in one direction only axially of the line and to hold the line against retrogressive movement in the opposite axial direction. Inclined surface cooperate to define a V-shaped gap into the nip. The V-shaped gap is located above the nip. The inclined surfaces have serrations thereon which lie (seen from above) tangent to circles, the center of which are coincident with the axes of the cam elements and which are inclined in the opening direction and are parallel to each other to effect, upon movement of the line toward the nip, a displacement of the cam elements an amount sufficient to receive the line within the nip without necessitating an axial movement of the line therethrough.

13 Claims, 4 Drawing Figures

LINE CLEATS FOR SECURING ROPES, BUT ESPECIALLY FOR LINES TO SAILS OF SAILBOATS

FIELD OF THE INVENTION

The invention relates to rope cleats, for securing ropes, but especially for securing lines to the sails of sailboats, having two cleats arranged on a base plate, of which at least one is movable, that is pivotal, whereby each cleat is perpendicular to the base plate and has a serrated cleat surface for the rope thereon and onto which are provided the upward inclined toothed surfaces, which form a V-shaped opening for the rope, and whereby the distance between the cleats depends on the size of the rope and pressure exerted by pull on the line or rope.

BACKGROUND OF THE INVENTION

In order to secure the lines, for example, to sails of sailboats, the so-called Curry-Cleat is known, which has two turnable cleats or cam elements, each having an axis of rotation and an eccentrically curved and serrated cleat surface, between which the line will be secured. Depending on the direction of the exercised tension on the line, the cleat, as a result of the friction contact of the line, is turned about its axis of rotation and thereby the operative space between the cleats either increases or is reduced. Through this, the line can be secured as well as released.

If a line is to be placed in such a cleat, then it is necessary in every case to put equal pressure on the cleats and pull axially on the line until the operative space between the cleats is increased so that the line will enter the resulting gap or nip. In every case, according to the spring force of the return spring for each cleat, a different magnitude of force is necessary in order to overcome the frictional resistance of the line on the cleats and to overcome the equal spring force of the return spring acting on the line in the spreading direction of the cleats. If the wind acting on the sail is strong, it will be very difficult to move the line axially thereof. In practice, it is not always possible to develop the necessary force for this and it becomes especially difficult for physically weak persons, for example, to adjust the desired position of the sail and line in the cleat of the sailboat. In addition, some body positions, such as with sailing especially in Jolly Boats, are not suitable to develop the necessary force to place the line in the clamp. In addition, the positioning of the rope cleat is not always favorable in practice.

A line cleat is known from U.S. Pat. No. 3,265,032 which has two turnable cleats or cam elements mounted on a base plate and a toothed or serration equipped cleat surface thereon and having an upwardly inclined fin-shaped surface which, in the same manner has teeth or serrations thereon. The fin-like surfaces form a V-shaped opening for the line and facilitate the entry of the line into the gap or nip between the cam elements. The tooth system on the inclined surface, as on the clamp surface, is vertical to the base plate on which the cleats are mounted. This means that on the inclined surface the continued toothing of the clamp surface in its extension intersects at a point which corresponds to approximately the central point of the radius of the arcuate clamp surface. Through this increases the space of the individual teeth at the point of the inclined surface, so that a rope in such a rope clamp, will require a considerable extension or expansion force to be set up to effect an insertion of the line into the nip and a considerable friction resistance to be overcome. Beyond that, the line, when it is pressed in between the cleats must necessarily also be moved in its axial direction contrary to the specific statement in the patent.

According to U.S. Pat. No. 3,265,032, one presses a line into the gap or nip of the cleat with toothing which is vertical to the base plate. In this way one produces the desired expansion action and the cleats also have, as intended, the tendency to swing open, they will be hindered by the line since the toothing of the inclined surface is engaged with the line and the spreading motion is only possible if at the same time the line is pulled axially which allows for a spreading or turning of the cleats. The teeth of the cleat according to U.S. Pat. No. 3,265,032 are vertically directed relative to the base plate and the V-shaped opening in between the cleats admits the line only as far as its diameter will permit with the spreading action not affecting the rotation of the cleats. Each rotating motion will be hindered by the vertical toothing on the inclined surfaces.

Based on this problem, it is an object of the invention to improve the line cleat with the discussed insertion method so that an insertion of the line between the clamps can result and simultaneously cause an opposite rotation or movement of the cleats in the spreading direction, that is, in the direction of pull on the line so that the eccentric clamping surfaces will progressively become spaced further apart as a result of the cleats being moved in opposite directions of rotation.

This problem is inventively resolved through the concept that each fin-like inclined surface has serrations thereon which have tooth profiles defining a working surface over which the line can slide with little resistance. The teeth on the inwardly facing fin-like inclined surfaces extend parallel to one another. The fin-like inclined surfaces define a V-shaped opening and a vertical insertion of the line into the V-shaped opening toward the base plate of the cleat will produce a force to effect a turning of the cleats. The spreading action of the cleats will be caused without a movement of the line in the axial direction.

Through the inclined and parallel arrangement of the serrations on the inclined surface, a vertical insertion of the line into the nip toward the base plate will effect the transformation of the vertical movement of the line to a horizontal movement of the cleats. This movement of the cleats will be obtained through the inclined arrangement of the serrations on the inclined surface in the spreading direction and, through this, one power component which is parallel to the base plate will operate on the cleats to cause the largest possible moment arm acting in a direction to effect an opening of the cleats. The automatic locking device in the area of the inclined surface will be further enhanced through the parallel and inclined arrangement of the serrations so that only a small force need be applied to the line to effect a placement of the line between the clamps.

The necessary force for insertion of the line between the cleat is then small, when the line engages the serrations on the inclined surfaces which are, as seen in a plan view, tangential to a circle, the axis of which is coincident with the pivot axis for the respective cleat. Advantageously at times, the middle serrations of the inclined surface will extend in the tangential direction, while the remaining serrations, that should lie parallel to the first, necessarily deviate some from the tangential direction.

It is also possible to make the fin-like inclined surface without serrations, that is, a smooth surface, so that the the opening of the cleats, a pressing in operation need only be used. A moving of the line in the axial direction by insertion of the line into the gap between the cleats does not need to occur, however higher insertion forces are necessary for the insertion of the line into the nip. The disadvantageous actions of the toothing of the fin-like surface according to U.S. Pat. No. 3,265,032 are not discussed here because the automatic locking device is not available as a result of the smooth surface construction.

BRIEF DESCRIPTION OF THE DRAWING

Three examples of the invention are illustrated in more detail in the drawing, in which.

DETAILED DESCRIPTION

Figure 1:
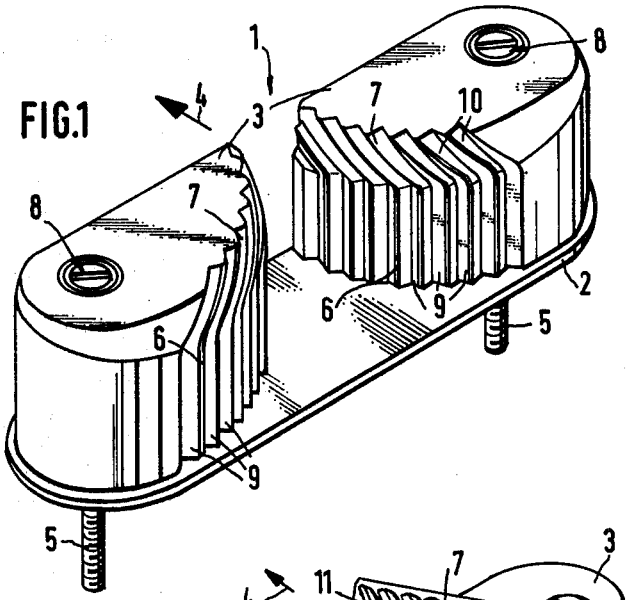
FIGS. 1 and 2 are perspective views of two different constructions of line cleats embodying the invention.

In the drawing, the line clamp according to the invention is referred to by the reference number 1. The line clamp 1 consists of a base plate 2 on which cleats or cam elements 3 are in a known manner pivotally secured. The cleats 3 are rotatable against a spring force from not illustrated springs in the direction of the arrow 4. The springs are similar to that illustrated in the aforementioned U.S. Pat. No. 3,265,032. The line cleat 1, with the aid of screws 5 for example, can be secured on the rim of the boat.

Each cleat 3 has an eccentrically curved clamping surface 6 thereon onto which an upwardly extending fin-like inclined surface 7 is provided and which is inclined at an angle to the clamping surface 6 and to the axis of rotation 8 for each of the cleats 3.

Each clamping surface 6 has serrations 9 thereon extending perpendicular to the base plate 2, while the serrations 10 on the inclined surface 7 extend at an angle to the serrations 9. These serrations extend on the inclined surfaces 7 which face each other and are generally parallel to each other. It can be seen from the drawing that the serrations of both inclined surfaces 7 extend away from each other to define a V-shaped entry to the nip between the serrated surfaces 6. In addition, the juncture between the clamping surface 6 and the inclined surface 7 on each cleat 3 defines a parting plane extending parallel to the base plate 2.

In the illustrated example of the construction, the serrations are so arranged that at least the middle serrations on the inclined surface 7, as seen in a top plan view, are tangential to a circle, the center of which coincides to the axis of rotation 8.

The inclined ascending serrations 10 on the inclined surfaces 7 are inclined in the spreading direction 4 and by insertion of a line, which is not shown in the drawing, in the V-shaped area between the inclined surfaces, the pressure component on the cleats which extends parallel to the base plate 2 can be utilized to cause an opening or pivoting of the cleats in the direction of the arrow 4. However, an insertion of the non-illustrated line between the cleats 3 into the nip in a direction perpendicular to the base plate 2 will not require an axial movement of the line because the cleats, through the working surfaces defined by the tooth profiles of the serrations 10 on the inclined surface 7 will simply permit the line to be pressed into the nip without requiring an axial movement of the line. This forms a so-called steep plane, which under the pressure of the line converts the vertical motion or radial movement of the line to a horizontal force to rotatably drive the cleats 3 in opposite directions to effect a widening of the nip to receive the line therebetween.

Figure 2:
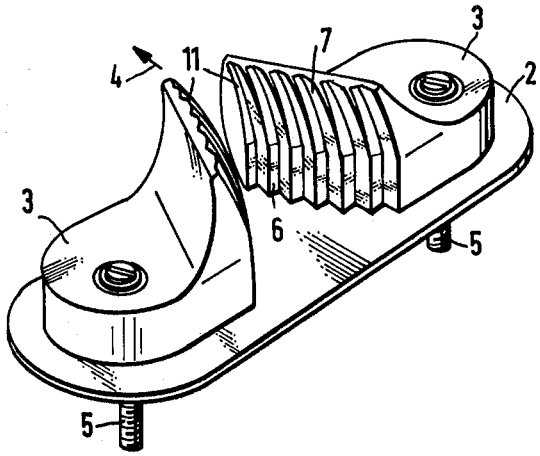

The illustrated example of the construction in FIG. 2 differentiates itself from the construction of FIG. 1 through the concept that the fin-like inclined surface 7 in the spreading direction 4 has a projection part 11 above the cleat surface 6. The projection part 11 defines an extended moment arm for causing an opening of the cleats through the application of a lesser amount of force thereby allowing for an even easier opening of the nip between the cleats.

Figure 3:
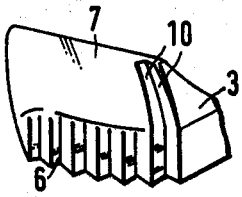
FIG. 3 is a fragmentary view of an alternate construction of the cleats.

In FIG. 3, the clamp surface 6 and the inclined surface of the cleat 3 is illustrated. This cleat has the feature that on the inclined surface 7 the serrations 10 are only arranged on the rear portion thereof and the remainder of the surface 7 in the spreading direction 4 is smooth. With such a cleat, the insertion of the line is also possible and no axial movement of the line is required. In addition, the insertion force is greater. It is also possible to form the entire inclined surface 7 without serrations. With this construction, it will also occur that the line can be inserted into the nip between the cleats without axial movement. In all cases, it is to be recognized that the force required to insert the line between the cleats is even greater than in the embodiment of FIGS. 1 and 2 due to the greater resistance which must be overcome.

Figure 4:
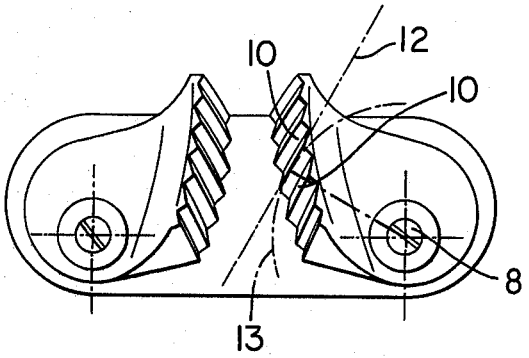
FIG. 4 is a top view of the cleats.

FIG. 4 shows a top view of a clamp as in FIG. 2. A tangent has been drawn in this top view on the crest between two grooves 10. This tangent, viewed in cross section, touches the arc 13, which is described around the pivot axis 8, and around which the clamping jaw is pivotal.

Although particular preferred embodiments of the invention have been disclosed in detail for illustrative purposes, it will be recognized that variations or modifications in the disclosed apparatus, including the rearrangement of parts, lie within the scope of the present invention.

The embodiments of the invention in which an exclusive property or privilege is claimed are defined as follows:

1. A cam cleat, comprising:

a base;

a cam element pivoted to said base about a pivot axis perpendicular to said base and having a first surface thereon;

means confronting said cam element on said base coacting therewith to form a line-receiving nip, said cam element being relatively displaceable in an opening direction about said pivot axis to vary the size of said nip for the accommodation of lines of different diameters;

spring means biasing said cam element and said confronting means toward each other;

first serration defining means on said first surface of said cam element extending parallel to each other in a first direction;

a second surface on said cam element extending upwardly from said first surface and diverging at an angle therefrom to define a V-shaped entry in the latter in cooperation with said confronting means; and second serration defining means on said second surface means extending in a second direction upwardly from the upper end of said first serration defining means and inclined to said base so that the upper end of said second serration defining means is laterally spaced on said second surface in said opening direction from the lower end thereof.

2. A cam cleat according to claim 1, wherein said serration defining means extend in planes tangent to circles, the centers of which coincide with the axis of rotation of said cam element.

3. A cam cleat according to claim 1, wherein the angle between said first and second surfaces vary with the course of the cam element.

4. A cam cleat according to claim 1, wherein said second surface in the spreading direction above said first surface has a projection thereon.

5. A cam cleat according to claim 1, wherein said second surface has at least two serrations thereon.

6. A cam cleat according to claim 1, wherein said second surface on the forward edge of said cam element in the spreading direction in part in said first surface passes over and to enlarge said nip on the forward edge, in the opening direction.

7. A cam cleat according to claim 1, wherein the diverging opening angle of the V-shaped entry in the direction of said second surface varies.

8. A cam cleat according to claim 1, wherein said second serration defining means are inclined in a direction of rotation of said cam element which effects a widening of said nip.

9. A cam cleat according to claim 8, wherein said confronting means comprises a second cam element that is a mirror image of the first mentioned cam element.

10. A cam cleat according to claim 8, wherein said inclination of said second surface and said second serration defining means thereon cause said cam element and said confronting means to respond to a downward thrust on said line by said line imparting a turning moment which remains the same throughout the time that said line engages said second surface and said second serration defining means thereon, said turning moment terminating upon entry of said line into engagement with said first surface and said first serration defining means thereon.

11. A cam cleat according to claim 10, wherein said parting plane is defined at the juncture between said first and second surfaces;

wherein said first serration defining means extending in said first direction are contained in planes perpendicular to said parting plane; and wherein said second serration defining means extending in said second direction are contained in planes inclined to said parting plane.

12. A cam cleat according to claim 1, wherein said second serration defining means includes at least one serration on said second surface, the remainder of said second surface being free of serration defining means thereon and smooth.

13. A cam cleat according to claim 12, wherein said at least one serration is located adjacent a trailing edge of said cam element when same is rotated in response to the insertion of said line into said nip.

* * * * *